US011394118B2

(12) United States Patent
Hsiao et al.

(10) Patent No.: US 11,394,118 B2
(45) Date of Patent: Jul. 19, 2022

(54) LOOP-LIKE DUAL-ANTENNA SYSTEM

(71) Applicant: ASUSTeK COMPUTER INC., Taipei (TW)

(72) Inventors: Ya-Wen Hsiao, Taipei (TW); Saou-Wen Su, Taipei (TW); Wei-Hsuan Chang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 69 days.

(21) Appl. No.: 17/073,496

(22) Filed: Oct. 19, 2020

(65) Prior Publication Data

US 2021/0126368 A1 Apr. 29, 2021

(30) Foreign Application Priority Data

Oct. 23, 2019 (TW) ..... 108138316

(51) Int. Cl.
*H01Q 7/00* (2006.01)
*H01Q 1/48* (2006.01)
*H01Q 1/38* (2006.01)

(52) U.S. Cl.
CPC ..... *H01Q 7/00* (2013.01); *H01Q 1/38* (2013.01); *H01Q 1/48* (2013.01)

(58) Field of Classification Search
CPC ..... H01Q 1/38; H01Q 1/48; H01Q 7/00
See application file for complete search history.

(56) References Cited

U.S. PATENT DOCUMENTS 5,557,293 A * 9/1996 McCoy ..... H01Q 1/243 343/702
7,339,543 B2 * 3/2008 Wang ..... H01Q 1/242 343/700 MS
9,325,070 B1 * 4/2016 Obeidat ..... H01Q 5/335
9,553,361 B2 * 1/2017 Hu ..... H03H 7/465
2002/0135523 A1 * 9/2002 Romero ..... H01Q 7/00 343/866

(Continued)

FOREIGN PATENT DOCUMENTS

CN 103339855 A 10/2013
TW M368906 U 11/2009

*Primary Examiner* — Graham P Smith
*Assistant Examiner* — Jae K Kim
(74) *Attorney, Agent, or Firm* — McClure, Qualey & Rodack, LLP

(57) ABSTRACT

A loop-like dual-antenna system is provided. The loop-like dual-antenna system includes a dielectric substrate having a first surface and a second surface opposite to each other. The loop radiating element includes a first radiating part with two ends and a second radiating part opposite to the first radiating part. A first signal source is disposed on the first surface of the dielectric substrate and electrically connected to two ends of the first radiating part. A grounding part is disposed on the second surface of the dielectric substrate and disposed on one side of the dielectric substrate away from the first signal source. A coupling matching element is disposed on the second surface of the dielectric substrate and adjacent to the grounding part, for coupling to and exciting the second radiating part. A second signal source, disposed on the second surface of the dielectric substrate, and electrically connected to the coupling matching element and the grounding part.

10 Claims, 6 Drawing Sheets

(56) References Cited

U.S. PATENT DOCUMENTS

| | | | | |
|---|---|---|---|---|
| 2009/0256763 | A1* | 10/2009 | Chi | H01Q 7/00 343/741 |
| 2009/0273530 | A1* | 11/2009 | Chi | H01Q 9/0421 343/741 |
| 2011/0063180 | A1* | 3/2011 | Su | H01Q 3/24 343/795 |
| 2011/0241953 | A1* | 10/2011 | Su | H01Q 21/28 343/728 |
| 2012/0293376 | A1* | 11/2012 | Hung | H01Q 9/42 343/702 |
| 2013/0002501 | A1* | 1/2013 | Li | H01Q 5/35 343/866 |
| 2013/0201074 | A1* | 8/2013 | Harper | H01Q 1/243 343/866 |
| 2015/0295311 | A1* | 10/2015 | Bringuier | H01Q 5/371 343/729 |
| 2016/0111772 | A1* | 4/2016 | Lilja | H01Q 1/243 343/702 |
| 2017/0062932 | A1* | 3/2017 | Foster | H01Q 1/38 |
| 2018/0053988 | A1* | 2/2018 | Lee | G04G 17/08 |
| 2019/0214730 | A1* | 7/2019 | Hsiao | H01Q 21/245 |
| 2019/0288395 | A1* | 9/2019 | Su | H01Q 1/38 |
| 2021/0126368 | A1* | 4/2021 | Hsiao | H01Q 1/38 |

* cited by examiner

LOOP-LIKE DUAL-ANTENNA SYSTEM

CROSS-REFERENCE TO RELATED APPLICATION

This application claims the priority benefit of Taiwan applications serial No. 108138316, filed on Oct. 23, 2019. The entirety of the above-mentioned patent application is hereby incorporated by reference herein and made a part of specification.

BACKGROUND OF THE INVENTION

Field of the Invention

The invention relates to a loop-like dual-antenna system.

Description of the Related Art

With the development trend of 5G communication, future 5G communication requires higher data rate and more stable signal quality. Therefore, Multiple Input Multiple Output (MIMO) has become one of the cores of 5G technology. The antenna design space also continues to shrink. Multiple antennas need to be housed in a limited space, which also causes degradation of isolation and affects radiation efficiency.

Taking the dual-antenna structure as an example, in order to improve the isolation between the dual antennas, the spacing of the dual-antenna unit is generally increased, or a decoupling element is added between the dual-antenna unit, such as resistive connecting elements or capacitive connecting elements to improve the isolation between the dual-antenna units. These dual-antenna structures can all be planar structures, and the end of the dual-antenna unit usually maintains an open structure without any components attached. In the design of the decoupling element, the decoupling element is still separate from the main radiator of the antenna unit. In addition to the low degree of integration with the dual-antenna unit, the distance between the dual-antenna units will also increase the overall size of the dual-antenna structure due to the additional decoupling element.

BRIEF SUMMARY OF THE INVENTION

According to an aspect, a loop-like dual-antenna system is provided. The loop-like dual-antenna system comprises: a dielectric substrate, includes a first surface and a second surface opposite to each other; a loop radiating element, disposed on the first surface of the dielectric substrate, the loop radiating element includes a first radiating part with two ends and a second radiating part opposite to the first radiating part; a first signal source, disposed on the first surface of the dielectric substrate and electrically connected to two ends of the first radiating part; a grounding part, disposed on the second surface of the dielectric substrate and disposed on one side of the dielectric substrate away from the first signal source; a coupling matching element, disposed on the second surface of the dielectric substrate and adjacent to the grounding part, for coupling to and exciting the second radiating part; and a second signal source, disposed on the second surface of the dielectric substrate, and electrically connected to the coupling matching element and the grounding part.

In summary, the loop-like dual-antenna system in the embodiments uses the structural design that two signal sources share the loop radiating element, which effectively reduces the overall size of the loop-like dual-antenna system. The position of current null excited by one of the signal sources is located at the maximum current areas excited by the other signal source, therefore, the isolation between the antennas is enhanced, and the loop-like dual-antenna system has advantages in a single antenna size and good radiation characteristics at the same time.

These and other features, aspects and advantages of the present invention will become better understood with regard to the following description, appended claims, and accompanying drawings.

DETAILED DESCRIPTION OF THE EMBODIMENTS

Figure 1:
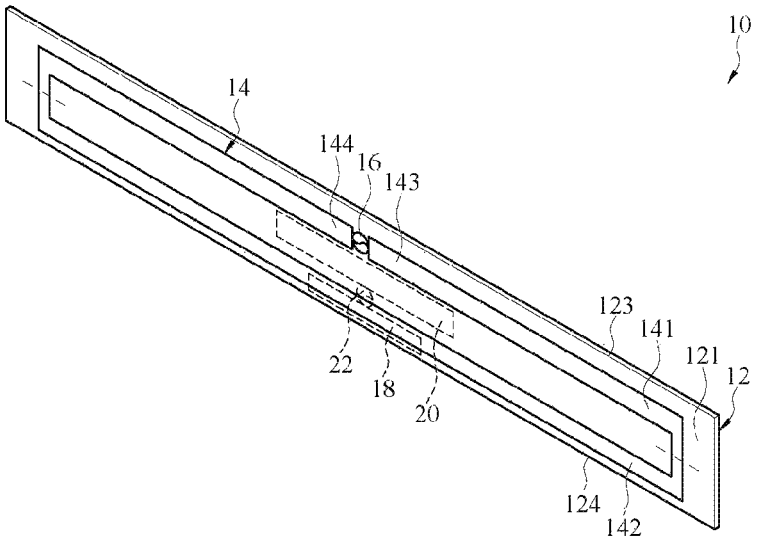
FIG. 1 is a schematic structural diagram of a loop-like dual-antenna system according to an embodiment.
Figure 2:
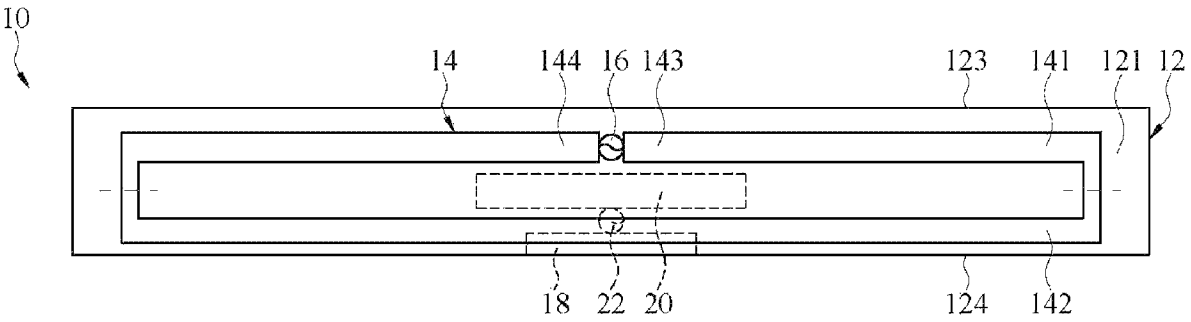
FIG. 2 is a top view of the loop-like dual-antenna system according to an embodiment.
Figure 3:
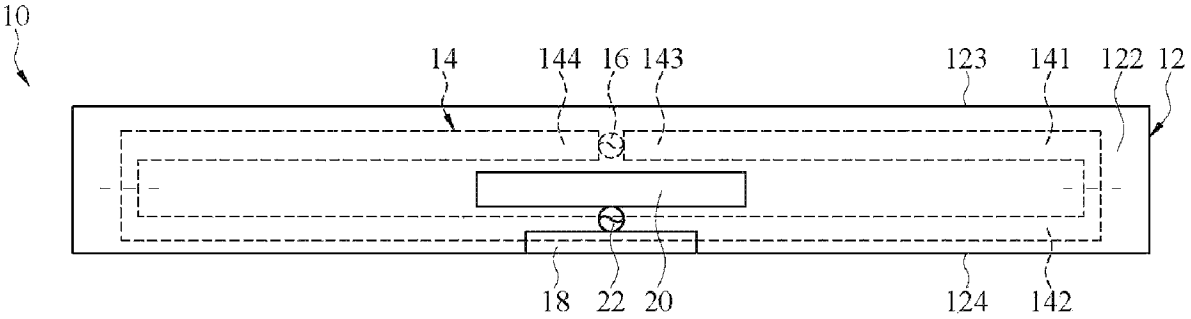
FIG. 3 is a bottom view of the loop-like dual-antenna system according to an embodiment.

FIG. 1 is a schematic structural diagram of a loop-like dual-antenna system according to an embodiment. FIG. 2 is a top view of the loop-like dual-antenna system according to an embodiment. FIG. 3 is a bottom view of the loop-like dual-antenna system according to an embodiment. Please refer to FIG. 1, FIG. 2 and FIG. 3. A loop-like dual-antenna system 10 includes a dielectric substrate 12, a loop radiating element 14, a first signal source 16, a grounding part 18, a coupling matching element 20, and a second signal source 22. The dielectric substrate 12 includes a first surface 121 and a second surface 122. The loop radiating element 14 and the first signal source 16 are disposed on the first surface 121 of the dielectric substrate 12, and the grounding part 18, the coupling matching element 20 and the second signal source 22 are disposed on the second surface 122 of the dielectric substrate 12.

In the loop-like dual-antenna system 10, the dielectric substrate 12 has a first long side 123 and a second long side 124. The loop radiating element 14 includes a first radiating part 141 with two ends 143, 144 and a second radiating part 142 opposite to the first radiating part 141. The first radiating part 141 is close to the first long side 123 of the dielectric substrate 12, the second radiating part 142 is close to the second long side 124 of the dielectric substrate 12, and the first radiating part 141 and the second radiating part 142 form a loop shape together. In one embodiment, the loop shape is a rectangular structure designed integrally.

The first signal source 16 is located on the first surface 121 of the dielectric substrate 12, and is electrically connected between two ends 143 and 144 of the first radiating part 141. In one embodiment, since the two ends 143 and 144 are at the geometric center of the first radiating part 141, the first signal source 16 is located at the center of the first radiating part 141.

The grounding part 18 is located on the second surface 122 of the dielectric substrate 12, and disposed on one side of the dielectric substrate 12 away from the first signal source 16. In one embodiment, the sides of the dielectric substrate 12 include the first long side 123 and the second long side 124, and the grounding part 18 is located on the edge of the second long side 124 of the dielectric substrate 12. The coupling matching element 20 is located on the second surface 122 of the dielectric substrate 12 and adjacent to the grounding part 18. The length direction of the coupling matching element 20 is parallel to the second long side 124, so that an appropriate interval always exists between the coupling matching element 20 and the grounding part 18. The second signal source 22 on the second surface 122 of the dielectric substrate 12 is electrically connected to the coupling matching element 20 and the grounding part 18, and then the second signal source 22 is coupled to and excites the second radiating part 142 through the coupling matching element 20.

In an embodiment, the first signal source 16 is located in the first radiating part 141, the first signal source 16 is adjacent to the second signal source 22, and the position of the first signal source 16 is the position of the current null excited by the second signal source 22. In detail, the first signal source 16 is located at the center position of the first radiating part 141, and the center position of the first radiating part 141 is the position of the current null excited by the second signal source 22. At least a part of the second signal source 22 overlaps with the vertical projection of the second radiating part 142 on the second surface 122 of the dielectric substrate 12, and the position of the second signal source 22 is the maximum current area excited by the first signal source 16.

In an embodiment, the overall antenna height of the loop-like dual-antenna system 10 is between 0.024 times to 0.056 times the wavelength of the operating frequencies of the antenna system (0.024λ to 0.056λ).

In the loop-like dual-antenna system 10 of an embodiment, when taking the connection line between the first signal source 16 and the second signal source 22 as a central axis, the loop radiating element 14 on the first surface 121 of the dielectric substrate 12, the coupling matching element 20 on the second surface 122 of the dielectric substrate 12, and the grounding part 18 are designed to be left-right symmetrical structure.

In an embodiment, the loop radiating element 14, the coupling matching element 20, and the grounding part 18 are made of a conductive material, such as copper, silver, aluminum, iron, or an alloy thereof, but are not limited herein.

Figure 4:
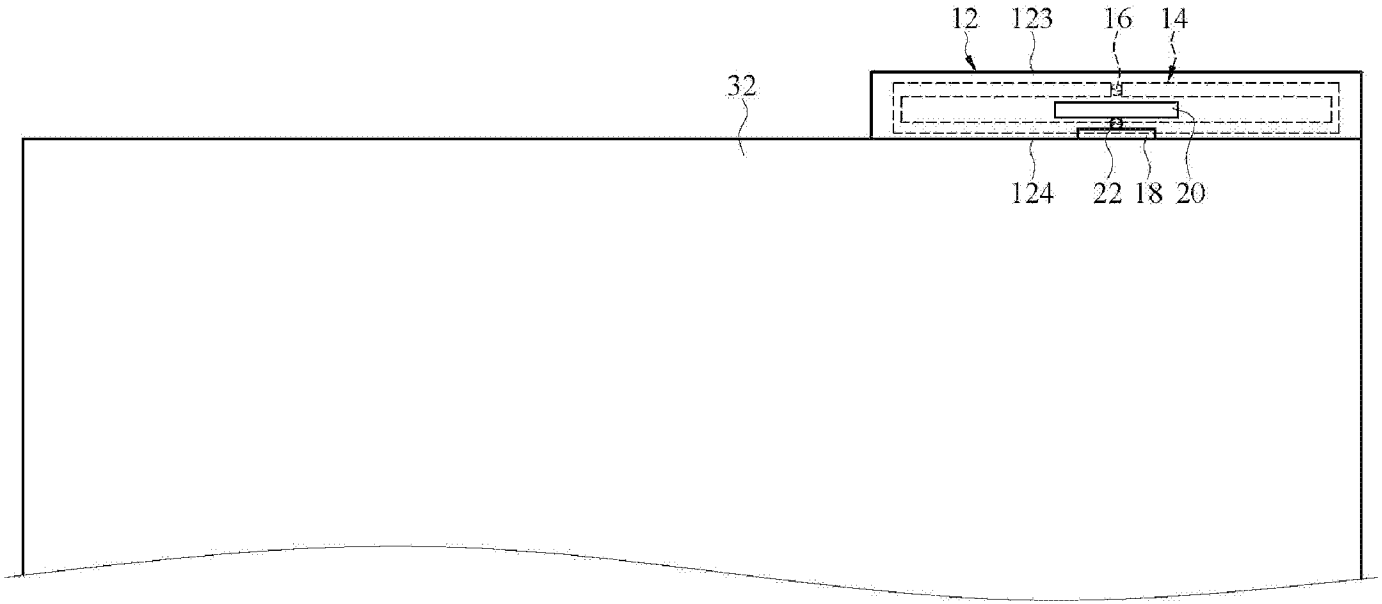
FIG. 4 is a schematic structural diagram of the loop-like dual-antenna system disposed on a system ground plane according to an embodiment.

FIG. 4 is a schematic structural diagram of the loop-like dual-antenna system disposed on a system ground plane according to an embodiment. Please refer to FIG. 1 to FIG. 4. The grounding part 18 is further electrically connected to a system ground plane 32, which is located on a side of the second long side 124 of the dielectric substrate 12. In an embodiment, the system ground plane 32 is an independent metal piece or a metal plane attached to an electronic device. For example, the system ground plane 32 is a grounding part of a metal case of an electronic device or a metal part inside the plastic case of the electronic device, which is not limited herein. The size of the system ground plane 32 drawn is for illustration only, which is adjustable according to the application of the loop-like dual-antenna system 10.

The first signal source 16 and the second signal source 22 adjacent to each other are respectively located on the first surface 121 and the second surface 122 of the dielectric substrate 12, and share the loop radiating element 14. The first signal source 16 is directly electrically connected to the loop radiating element 14 to directly feed the signal to the loop radiating element 14. The second signal source 22 is a distributed capacitive coupling signal source formed by the coupling matching element 20 and the loop radiating element 14 when the signal of the first signal source 16 is fed into the loop radiating element 14. Therefore, it can be known from the above that the first signal source 16 and the second signal source 22 share the same loop radiating element 14, and each of the first signal source 16 and the second signal source 22 generates a resonant mode of about one wavelength at the operating frequencies. In an embodiment, the aforementioned operating frequency band is an operating frequency band covering 2.4 GHz to 2.5 GHz.

Figure 5:
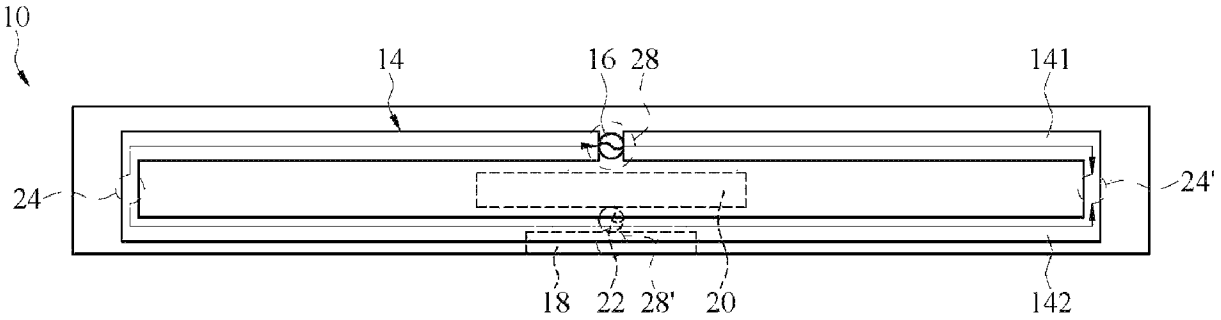
FIG. 5 is a schematic diagram of current distribution of a first signal source of the loop-like dual-antenna system according to an embodiment.
Figure 6:
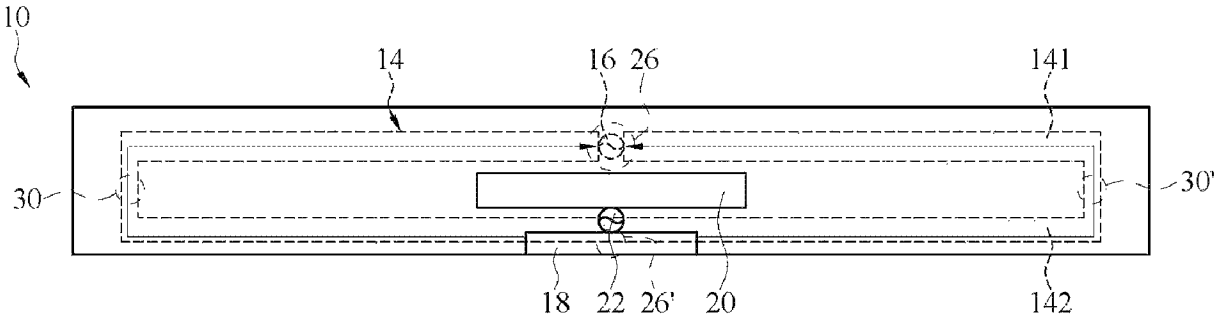
FIG. 6 is a schematic diagram of current distribution of a second signal source of the loop-like dual-antenna system according to an embodiment.

When the first signal source 16 and the second signal source 22 are excited, the loop-like dual-antenna system 10 generates the resonant mode of about one wavelength and generates two current nulls on the resonant path. In detail, please referring to FIG. 5, when the first signal source 16 is excited, the surface currents of the loop radiating element 14 generates two current nulls 24 and 24', which are respectively located at two sides where the first radiating part 141 and the second radiating part 142 are connected. Please refer to FIG. 6. When the second signal source 22 is excited, the surface current of the loop radiating element 14 also generates two current nulls 26 and 26', which are respectively located on the geometric center position of the first radiating part 141 and the second radiating part 142. Please refer to FIG. 5 and FIG. 6 at the same time, the positions of the current nulls 24 and 24' excited by the first signal source 16 are located at two maximum current areas 30, 30' excited by the second signal source 22, and the positions of the two current nulls 26, 26' excited by the second signal source 22 are located at two maximum current areas 28, 28' excited by the first signal source 16. Thereby, the isolation of the loop-like dual-antenna system 10 is greatly improved. At the same time, the two radiation fields of the loop-like dual-antenna system 10 also achieves orthogonal polarization characteristics.

Figure 7:
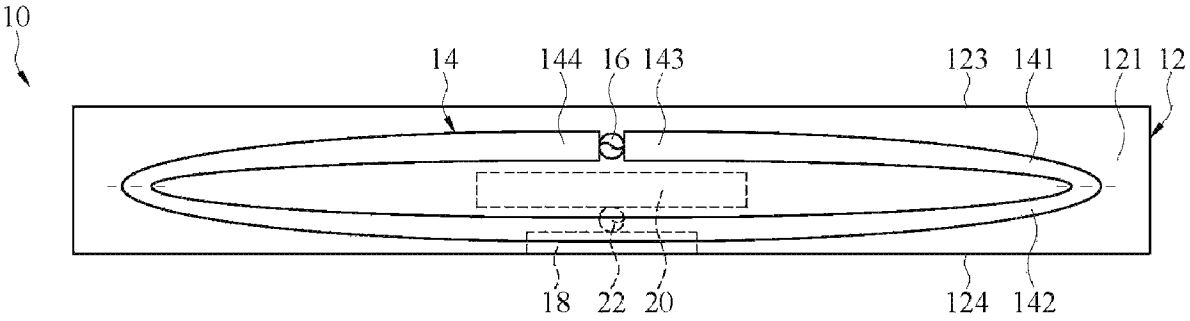
FIG. 7 is a schematic structural diagram of a loop-like dual-antenna system according to another embodiment.

FIG. 7 is a schematic structural diagram of a loop-like dual-antenna system according to another embodiment. Please refer to FIG. 7. In the loop-like dual-antenna system 10, the loop radiating element 14 has different implementations. The loop radiating element 14 on the first surface 121 of the dielectric substrate 12 is an elliptical loop design. The loop radiating element 14 includes the first radiating part 141 with two ends 143, 144 and the second radiating part 142 opposite to the first radiating part 141. The first radiating part 141 is near the first long side 123 of the dielectric substrate 12, the second radiating part 142 is near the second long side 124 of the dielectric substrate 12, and the first signal source 16 is electrically connected between the two ends 143 and 144 of the first radiating part 141. Except that the shape design of the loop radiating element 14 is different, the rest of the structure and the actuation system are the same as those in the embodiment shown in FIG. 1. The loop shape of the loop radiating element 14 can be designed in different shapes according to actual needs, and is not limited to the rectangle shape shown in FIG. 2 and the ellipse shape shown in FIG. 7.

Please refer to FIG. 1 to FIG. 4. The actual overall size of the loop-like dual-antenna system 10 is 40 mm in length, 5 mm in width, and the antenna area is 200 square millimeters, which is smaller than the 300-320 square millimeters of a single antenna commonly used in the industry, therefore, a dual-antenna system is achieved by using only a single antenna space, which is actually a structural design of a small-sized dual-antenna system. Specifically, the loop radiating element 14 formed by the first radiating part 141 and the second radiating part 142 has a length of 40 mm, a height of 4.5 mm. In an embodiment, the coupling matching element 20 has a length of 10 mm and is used to optimize the impedance matching of the antenna in 2.4 GHz frequency band. The distance between the first signal source 16 and the second signal source 22 is 2 mm.

Figure 8:
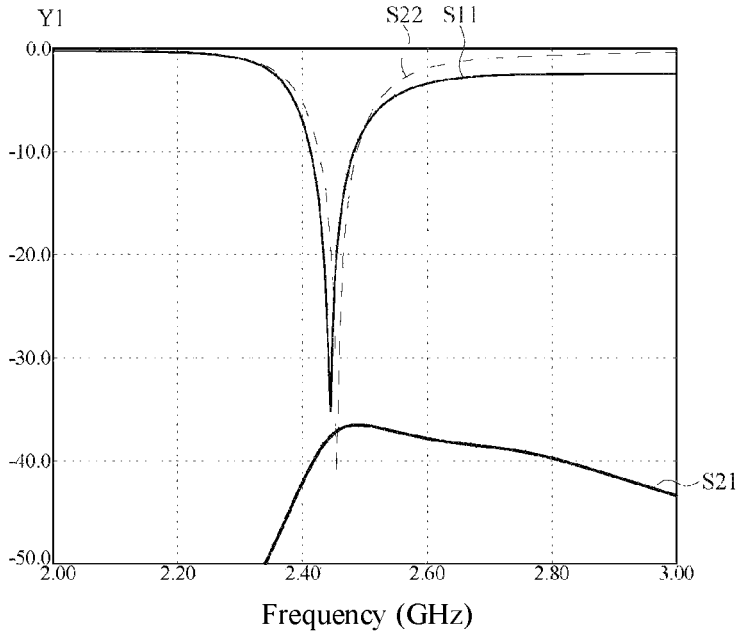
FIG. 8 is an S-parameter simulation schematic diagram of the loop-like dual-antenna system according to an embodiment.

FIG. 8 is an S-parameter simulation schematic diagram of the loop-like dual-antenna system according to an embodiment. Please refer to FIG. 1 to FIG. 4 and FIG. 8 at the same time. In order to prove that the loop-like dual-antenna system 10 does have a good isolation effect, the loop-like dual-antenna system 10 of the aforementioned size is used to simulate S-parameters. In the operating band (2.4 GHz), the S-parameter results are shown in FIG. 8. The isolation curve (S21) is better than 30 dB in the operating band, and the reflection coefficients (S11, S22) of the antenna operating band is less than −10 dB, so it has good isolation in the 2.4 GHz band. Therefore, the loop-like dual-antenna system 10 in the embodiments has good isolation in the single frequency band.

In summary, in order to solve the problem of isolation between dual antennas, the loop-like dual-antenna system in the disclosure uses the structural design that the first signal source and the second signal source share the loop radiating element, effectively reduce the overall size of the loop-like dual-antenna system, and the position of the current null excited by the first signal source is located at the maximum current area excited by the second signal source, and vice versa. Therefore, the isolation between antennas is enhanced, so that the loop-like dual-antenna system has the advantages of a single antenna size and good radiation characteristics at the same time, which is very suitable for application in electronic devices with small antennas and multiple antennas.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A loop-like dual-antenna system, comprising:

a dielectric substrate, including a first surface and a second surface opposite to each other;

a loop radiating element, disposed on the first surface of the dielectric substrate, the loop radiating element includes a first radiating part with two ends and a second radiating part opposite to the first radiating part;

a first signal source, disposed on the first surface of the dielectric substrate and electrically connected to the two ends of the first radiating part;

a grounding part, disposed on the second surface of the dielectric substrate and disposed on one side of the dielectric substrate away from the first signal source;

a coupling matching element, disposed on the second surface of the dielectric substrate and adjacent to the grounding part, for coupling to and exciting the second radiating part; and a second signal source, disposed on the second surface of the dielectric substrate, and electrically connected to the coupling matching element and the grounding part.

2. The loop-like dual-antenna system according to claim 1, wherein the first signal source is adjacent to the second signal source, the first signal source is located on the first radiating part, and at least a part of the second signal source overlaps with the vertical projection of the second radiating part on the second surface of the dielectric substrate.

3. The loop-like dual-antenna system according to claim 2, wherein the first signal source is located at the center position of the first radiating part.

4. The loop-like dual-antenna system according to claim 1, wherein the position of the first signal source is the position of the current null excited by the second signal source, and the position of the second signal source is a maximum current area excited by the first signal source.

5. The loop-like dual-antenna system according to claim 4, wherein two current null areas excited by the first signal source are located at two maximum current areas excited by the second signal source; and the position of two current nulls excited by the second signal source are located at two maximum current areas excited by the first signal source.

6. The loop-like dual-antenna system according to claim 1, wherein the first signal source is directly electrically connected to the loop radiating element, to directly feed the signal to the loop radiating element.

7. The loop-like dual-antenna system according to claim 6, wherein the second signal source is a distributed capacitive coupling signal source formed by the coupling matching element and the loop radiating element when the signal of the first signal source is fed into the loop radiating element.

8. The loop-like dual-antenna system according to claim 1, wherein the grounding part is further connected to a system ground plane.

9. The loop-like dual-antenna system according to claim 1, wherein the length direction of the coupling matching element is parallel to the side the coupling matching element.

10. The loop-like dual-antenna system according to claim 1, wherein the antenna height of the loop-like dual-antenna system is between 0.024 to 0.056 times the wave length of operating frequencies.

* * * * *